US011148919B1

(12) United States Patent
Middleton

(10) Patent No.: US 11,148,919 B1
(45) Date of Patent: Oct. 19, 2021

(54) METHOD AND APPARATUS FOR LIFTING HEAVY LOAD

(71) Applicant: Timothy Lane Middleton, Seminary, MS (US)

(72) Inventor: Timothy Lane Middleton, Seminary, MS (US)

( * ) Notice: Subject to any disclaimer, the term of this patent is extended or adjusted under 35 U.S.C. 154(b) by 84 days.

(21) Appl. No.: 16/802,712

(22) Filed: Feb. 27, 2020

(51) Int. Cl.
*B66F 9/18* (2006.01)
*B65D 19/38* (2006.01)

(52) U.S. Cl.
CPC ..... *B66F 9/18* (2013.01); *B65D 19/38* (2013.01); *B65D 2519/00786* (2013.01); *B65D 2519/00796* (2013.01)

(58) Field of Classification Search
CPC .... B66F 9/12; B66F 9/127; B66F 9/18; B66C 1/12; B66C 1/14
See application file for complete search history.

(56) References Cited

U.S. PATENT DOCUMENTS 2,558,388 A 6/1951 Richardson
2,696,317 A * 12/1954 Toffolon ..... B66F 9/18 414/607
3,007,592 A 11/1961 Adams
3,283,933 A * 11/1966 Vander Wal ..... B66F 9/12 414/607
3,587,893 A 6/1971 Laken
4,688,981 A * 8/1987 Ravnsborg ..... B66F 9/12 414/607
7,226,209 B2 * 6/2007 Jardine ..... B65D 88/1687 383/24
8,454,295 B2 * 6/2013 Balcom ..... B66F 9/12 414/607
10,301,157 B1 * 5/2019 Kramer ..... B66F 9/18
10,556,783 B2 * 2/2020 Ivey ..... B66F 9/12
10,723,605 B2 * 7/2020 Ivey ..... B66F 9/19
10,858,229 B1 * 12/2020 Tucker ..... B66F 9/18
2020/0207396 A1 * 7/2020 Espy ..... B62B 3/06

FOREIGN PATENT DOCUMENTS

JP 2010/149925 A 7/2010

* cited by examiner

*Primary Examiner* — Mark C Hageman
(74) *Attorney, Agent, or Firm* — George L Williamson

(57) ABSTRACT

Method and apparatus for a material handling attachment being generally rectangular having left and right tubular main frame members for receiving the corresponding left and right lifting forks of a forklift truck. The tubular main frame members are supported by front and rear cross members and a floor is formed of expanded metal placed on an upper surface of the material handling attachment. The material handling attachment has a downwardly extending pad eye lifting lug at each corner for attaching a downwardly extending first strap having connecting means on its ends for attachment to a second strap which directly carries a cargo load or which passes through the opening formed in a pallet so that the pallet having heavy cargo thereon can be easily lifted using the forklift truck. The material handling attachment allows the cargo load or pallet to be lifted directly off the ground and moved about so that it can then be lowered onto the bottom floor of a cargo vehicle so that a pallet passes over the walls of the cargo vehicle.

12 Claims, 3 Drawing Sheets

METHOD AND APPARATUS FOR LIFTING HEAVY LOAD

BACKGROUND OF THE INVENTION

Field of the Invention

The present invention relates generally to material handling attachments, and more particularly, is concerned with a material handling attachment for a forklift truck.

Description of the Related Art

Devices relevant to the present invention have been described in the related art; however, none of the related art devices disclose the unique features of the present invention.

In U.S. Pat. No. 2,696,317 dated Dec. 7, 1954, Toffolon disclosed a fork truck lifting attachment. In U.S. Pat. No. 2,558,388 dated Jun. 26, 1951, Richardson disclosed a fork truck lift frame attachment. In U.S. Pat. No. 3,587,893 dated Jun. 28, 1971, Laken disclosed a material handling attachment for lift trucks. In U.S. Pat. No. 3,007,592 dated Nov. 7, 1961, Adams disclosed a hoist attachment for forklift trucks. In U.S. Pat. No. 8,454,295 dated Jun. 4, 2013, Balcom disclosed a detachable boom apparatus for fork trucks. In Japanese Patent Application No. JP 2010/149925 (A) dated Jul. 8, 2010, Masayuki, et al., disclosed a hanging machine for pallet.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a material handling attachment being generally rectangular having left and right tubular main frame members for receiving the corresponding left and right lifting forks of a forklift truck. The tubular main frame members are supported by front and rear cross members and a floor is formed of expanded metal placed on an upper surface of the material handling attachment. The material handling attachment has a downwardly extending pad eye lifting lug at each corner for attaching a downwardly extending first strap having connecting means on its ends for attachment to a second strap which directly carries a cargo load or which passes through the opening formed in a pallet so that the pallet having heavy cargo thereon can be easily lifted using the forklift truck. The material handling attachment of the present invention allows the cargo load or pallet to be lifted directly off the ground and moved about so that it can then be lowered onto the bottom floor of a trailer or other cargo vehicle so that a pallet passes up and over the walls of the trailer or other cargo vehicle and then down onto the bottom floor.

An object of the present invention is to provide a material handling attachment which can be easily connected to the lifting forks of a forklift truck so that heavy cargo loads can be lifted using the forklift truck. A further object of the present invention is to provide a material handling attachment which can be simply and quickly connected to the lifting forks of a forklift truck. A further object of the present invention is to provide a material handling attachment which can be used to lift loads vertically and moved laterally using the forklift truck so as to pass the load over the walls of the cargo vehicle. A further object of the present invention is to provide a material handling attachment which can be easily operated by a user. A further object of the present invention is to provide a material handling attachment which can be easily and relatively inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
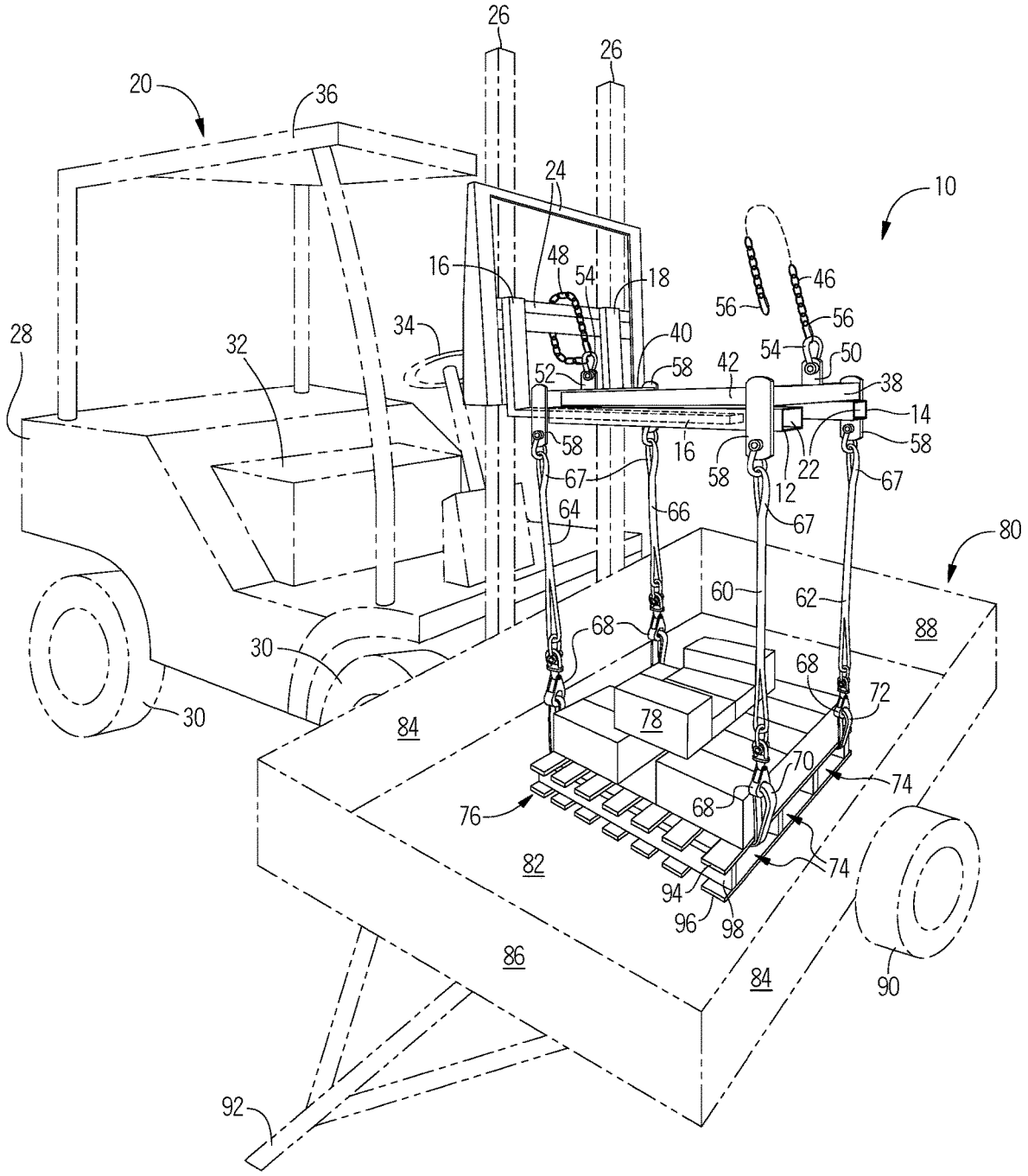
FIG. 1 is a perspective view of the present invention shown in operative connection.

With regard to reference numerals used, the following numbering is used throughout the drawings.

10 present invention/material handling attachment
12 right tubular main frame member
14 left tubular main frame member
16 right lifting fork
18 left lifting fork
20 forklift truck
22 conduit
24 carriage for lifting fork
26 vertical lifting mechanism
28 chassis
30 wheels
32 seat
34 steering wheel
36 roof
38 front cross member
39 expanded metal floor
rear cross member
42 right angle iron wall
44 left angle iron wall
46 front safety chain
48 rear safety chain
50 front upwardly extending pad eye lifting lug
52 rear upwardly extending pad eye lifting lug
54 shackle
55 barrel screw

56 quick link
58 downwardly extending pad eye lifting lugs
60 strap
62 strap
64 strap
66 strap
67 eyehook of strap
68 connector
70 right pallet strap
72 left pallet strap
74 opening of pallet
76 pallet
78 cargo load
80 trailer
82 bottom floor
84 sidewalls
86 front end wall
88 rear end wall
90 wheels
92 tongue
94 top deckboard
96 bottom deckboard
98 stringer
100 nut
102 bolt

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 5 illustrate the present invention wherein a material handling attachment for use with a forklift truck is disclosed and which is generally indicated by reference numeral 10.

Turning to FIG. 1, therein is shown the material handling attachment 10 of the present invention having a framework including right and left tubular members 12, 14 which may be rectangular in shape, in which the tubular members are provided and sized and shaped to slidingly receive the right and left lifting forks 16, 18 of the forklift truck 20 by having the lifting forks pass through the corresponding conduits 22 of the tubular members 12, 14 which are approximately six inch by three inch tubing being open on either end so that the forklift truck 20 can approach the present invention 10 from either end for connection thereto. The lifting forks 16, 18 are carried on the lifting fork carriage 24 of the forklift truck 20 which carriage is movable attached to the vertical lifting mechanism 26 so that the carriage 24 can travel in a vertical direction upwardly and downwardly. The forklift truck also has a chassis 28 containing the motor (not shown) having a plurality of wheels 30 along with a seat 32, steering wheel 34, and a roof 36 for covering the operator (not shown) who is inside the forklift truck 20 in a conventional manner. The material handling attachment 10 also has front and rear cross members 38, 40 made of approximately three inch by three inch tubing along with right and left angle iron sidewalls 42, 44. Also, front and rear 46, 48 safety chains are used to secure the material handling attachment 10 to the carriage 24 so as to prevent the material handling attachment 10 from being pulled off the lifting forks 16, 18 due to the weight of the cargo load 78 being lifted. Cargo load 78 is a load of concrete blocks, or the like, but could be a load of any commodity/merchandise which could be carried on a pallet 76, such as, shingles, lumber, pipe, or other similar construction materials. The front and rear safety chains 46, 48 are connected to front and rear upwardly extending pad eye lifting lugs 50, by shackles 54 to which the safety chains are connected so that the safety chains are secured to the cross members 38, 40. A plurality of quick link fasteners 56, which are shaped similarly to links of a chain and which are commonly used for joining chain links together, are used for joining the safety chain 46, 48 to the shackles 54 in a standard manner as would be done by one skilled in the art. The downwardly extending pad eye lifting lugs 58 are disclosed and shown on each corner for supporting the downwardly extending first straps 60, 62, 64, 66 being about 2" to 6" wide and which are connected to the downwardly extending pad eye lifting lugs 58 by using a heavy duty approximate ⅝" shackle 54 as would be done in the standard manner by one skilled in the art. Connectors 68 are shown on the lower end of the straps 60-66 so that the connector 68 (which may be of the self closing hook type) can be joined to the ends of right and left second straps 70, 72 which are pallet straps being about 2" to 6" wide and which pass through openings 74 in the pallet 76 so that a load 78 can be picked up using the pallet 76 and the lifting forks 16, 18 of the forklift truck 20. The openings 74 are spaced apart approximately the same width of the lift forks 16,18 so that straps 60-66 hang substantially straight down.

The material handling attachment 10 is useful for placing a cargo 78 on the inside of a trailer 80, or like cargo vehicle such as a pickup truck, and on the bottom floor 82 of the trailer 80 by lifting and moving the cargo load 78 up and over the sidewalls 84 of the trailer 80 for placement on the inside bottom floor 82 of the trailer 80. The trailer 80 has left and right sidewalls 84 along with a front end wall 86, and a rear end wall 88 along with wheels 90 and a tongue 92 so that the trailer can be attached to a towing vehicle (not shown). The pallet 76 has a plurality of top deckboards 94 and a plurality of bottom deckboards 96 separated by a plurality of spaced apart stringers 98, including near opposite ends of the deckboards, which thereby forms the opening 74 between the top and bottom deckboards. The second right and left pallet straps 70, 72 are passed through the openings 74 of the pallet 76 so that they can be connected to the first straps 60, 62, 64, 66. Each of the straps 60, 62, 64, 66 have an eyehook 67 on each of its ends which are connected with various types of connectors or fasteners for easy joining with the other straps used in the present invention 10.

Figure 2:
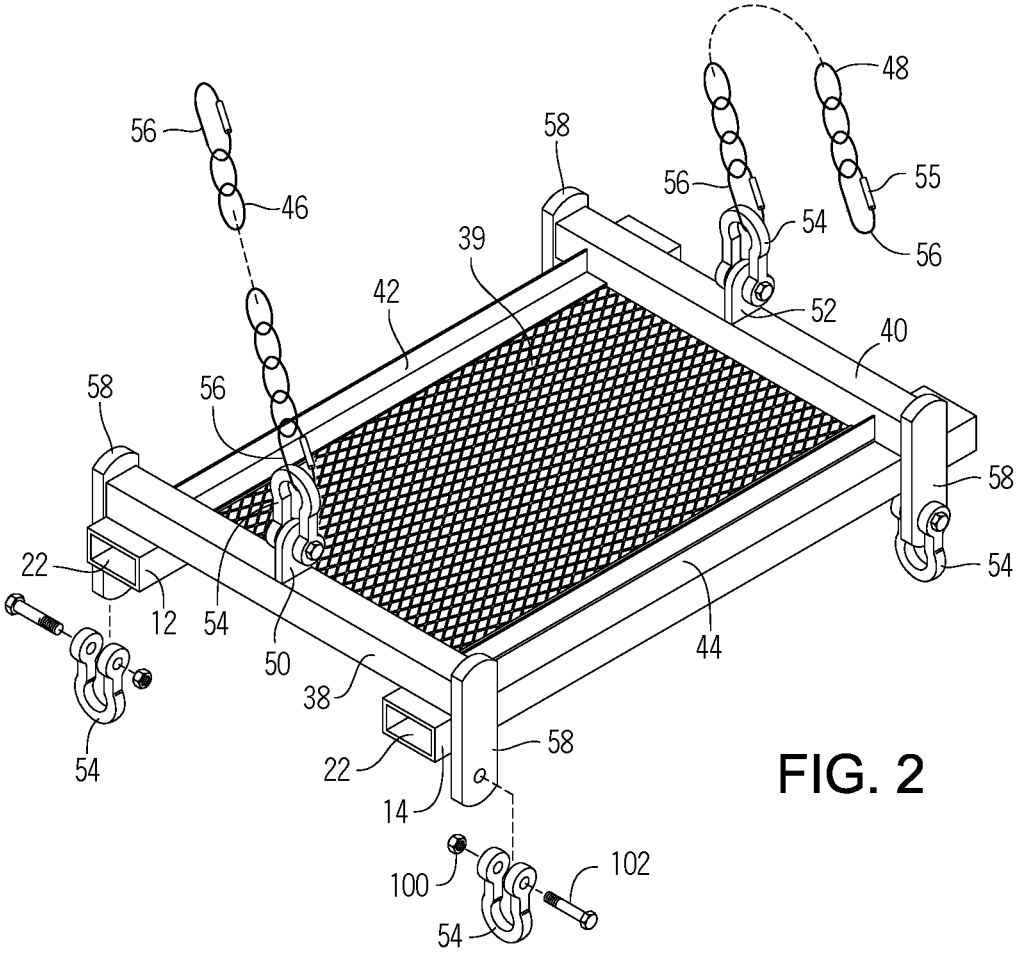
FIG. 2 is a perspective view of the material handling attachment of the present invention.

Turning to FIG. 2, shown therein are the right and left main frame members 12, 14 along with the front and rear cross members 38, 40, having a front and rear upwardly extending pad eye lifting lug 50, 52 attached on an upper surface thereof, right and let angle iron walls 42, 44 covering a floor 39 being centrally disposed in the material handling attachment 10 wherein the floor is comprised of expanded metal so that the various connectors and rigging, such as the straps and chains, can be stored on the expanded metal floor 39. The angle iron walls 42, 44 serve to contain the items of rigging stored on top of floor 39 and to cover the edges of the expanded metal 39 to prevent a user from being cut or otherwise injured by the sharp edges of the expanded metal which rests on an upper surface of the left and right main frame members 12, 14. Shackles 54 are used for connecting the front and rear safety chains 46, 47 to the front and rear upwardly extending pad eye lifting lugs 50, 52. Quick links 56 are used to join segments of the front and rear safety chains 46,48 in the standard manner as would be done by one skilled in the art. Each of the quick links 56 has a barrels screw 55 which is connected to threaded ends of the segments of the quick links 56 as would be done in the standard manner. Downwardly extending pad eye lifting lugs 58 are disposed on each corner having shackles 54 connected thereto using a nut 100 and a bolt 102 as would be done in the standard manner by one skilled in the art. Other previously disclosed elements may also be shown.

Figure 3:
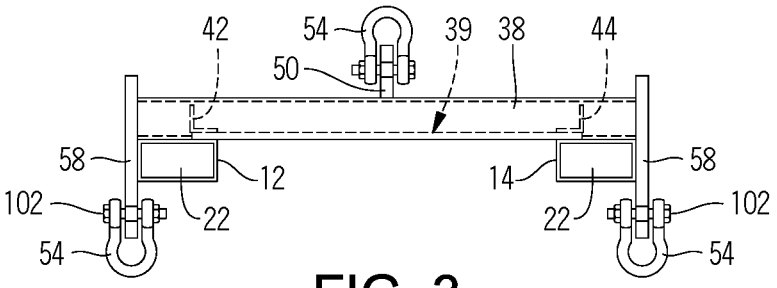
FIG. 3 is a front elevation view of the material handling attachment of the present invention.
Figure 4:
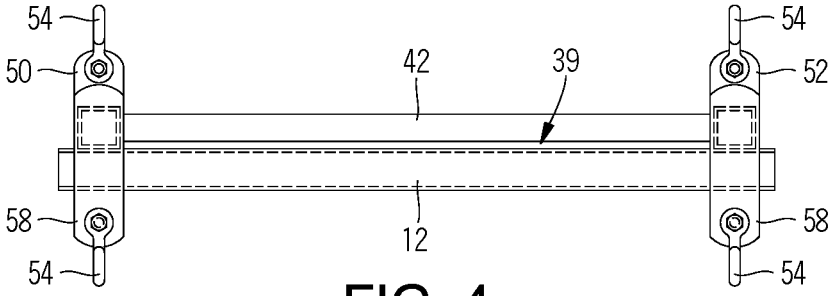
FIG. 4 is a side view of the material handling attachment of the present invention.

Turning to FIG. 3-4, therein are shown previously disclosed elements similar to FIG. 2 above.

Figure 5:
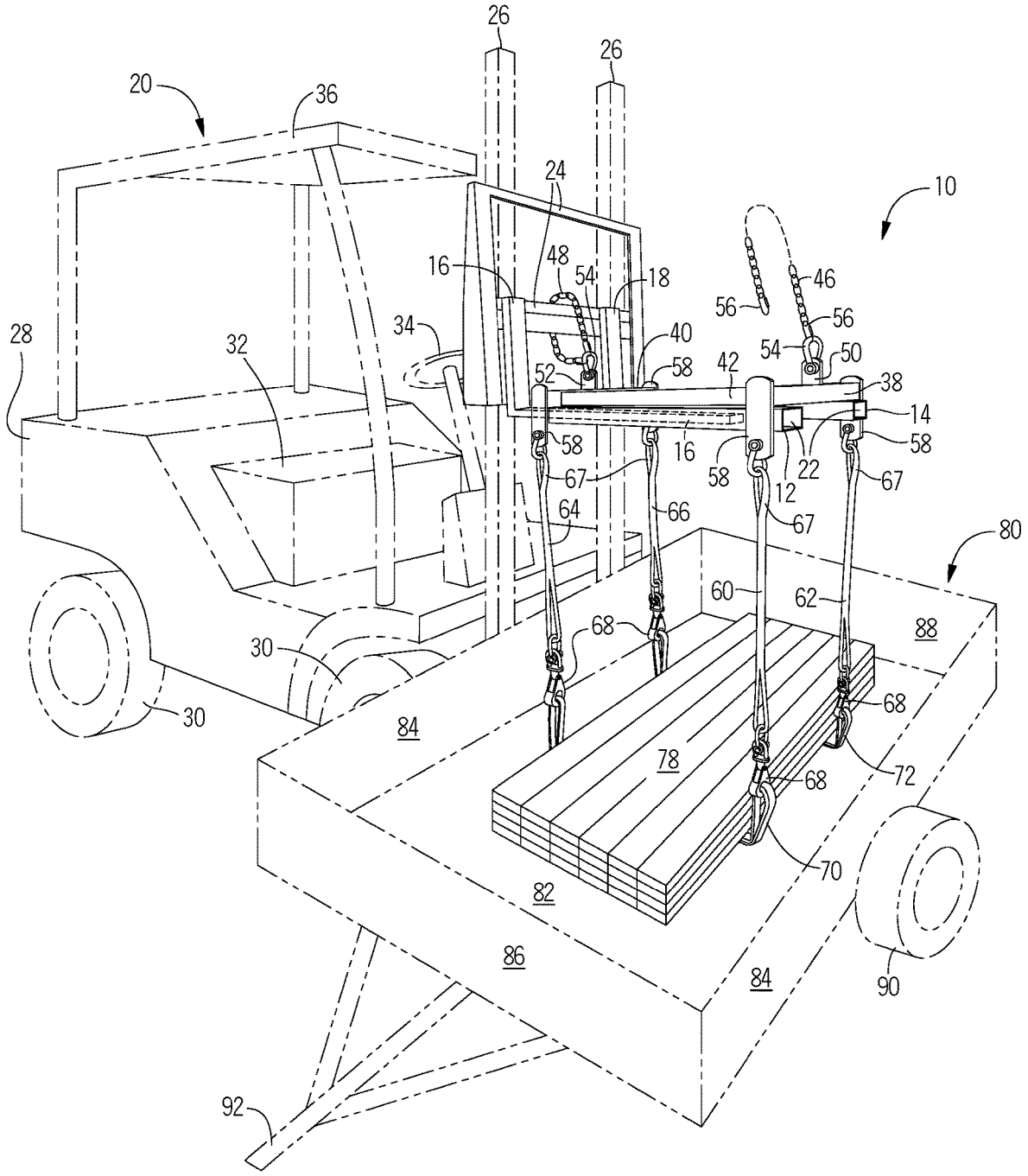
FIG. 5 is a perspective view of the present invention shown in operative connection.

Turning to FIG. 5, therein is shown the material handling attachment 10 of the present invention along with its framework including all elements similar to FIG. 1 except that the cargo load 78, which is a load of lumber, is being carried directly on the top of the second straps 70,72 without using a pallet.

The present invention 10 is expected to be made of metal, such as iron or steel, and while it may be joined together by any suitable means, is expected to be welded so as to provide maximum strength. The straps/slings of the present invention 10 are expected to be made of nylon or the like, being very strong synthetic material.

A pallet 76, as used in this patent application, is a flat transport structure which supports cargo 78 in a stable fashion while being lifted by a forklift truck 20 or the like. Cargo 78 is often stacked on a pallet 76 and secured with strapping or shrink wrap and shipped. Pallets are typically made of wood but may be made of other material, such as plastic-like material.

Left and right side designations regarding the present invention 10 are interpreted from the view of one seated in the seat 32 of forklift 20 and facing forwardly, i.e., toward the cargo 78.

Expanded metal as used for floor 39, as used in this application, is a type of metal which has been cut and stretched to form a regular pattern (often diamond-shaped) of metallic mesh-like material. It is commonly used for fences and grates. Expanded metal is stronger than an equivalent weight of wire mesh such as chicken wire because the material is flattened, allowing the metal to stay in one piece. The other benefit to expanded metal is that the metal is never completely cut and reconnected, allowing the material to retain its strength.

By way of summary and with reference to FIGS. 1-5, the present invention 10 discloses a method and apparatus of assembling a material handling attachment 10 for a forklift truck 20, the forklift truck having left and right lifting forks 16,18 including a framework having left and right tubular main frame members 12,14, each tubular main frame member having a conduit 22 inside for receiving the corresponding left and right lifting forks of the forklift truck therein; a front and rear cross member 38,40 on an upper surface of the left and right tubular main frame member and an expended metal floor 39 on the upper surface of the left and right tubular main frame member; a left and right angle iron wall 42,44 on opposite edges of the expanded metal floor so that outer edges of the expanded metal floor are covered; a plurality of downwardly extending pad eye lifting lugs 58 on the framework; a first strap 6-66 extending from each downwardly extending pad eye lifting lug; a cargo load 78 supported and carried by a plurality of second straps 70,72; and wherein the first straps are removably connected at 68 to the second straps to permit the cargo load to be lifted and carried by the forklift truck. Also shown is a pallet 76 for supporting the cargo load along with left and right openings 74 for receiving left and right second straps. Also shown are safety chains 46,48 for joining the front and rear cross member to the forklift truck along with the framework being rectangular (see FIGS. 2-4) and having four corners wherein one downwardly extending pad eye lifting lug is extended from each corner of the framework.

I claim:

1. A material handling attachment for a forklift truck, the forklift truck having left and right lifting forks, comprising:

(a) a framework having left and right tubular main frame members, each said tubular main frame member having a conduit inside for receiving the corresponding left and right lifting forks of the forklift truck therein, wherein said conduit is open on opposite ends thereof;

(b) a front and rear cross member disposed on an upper surface of said left and right-tubular main frame member, an expanded metal floor disposed on said upper surface of said left and right tubular main frame member upon which items can be stored;

(c) a left and right angle iron wall disposed on opposite edges of said expanded metal floor so that outer edges of said expanded metal floor are covered and for containing items on said expanded metal floor;

(d) a plurality of downwardly extending pad eye lifting lugs disposed on said framework;

(e) a first strap extending from each said downwardly extending pad eye lifting lug;

(f) a cargo load carried by a plurality of second straps; and (g) wherein said first straps are removably connected to said second straps to permit said cargo load to be lifted by the forklift truck.

2. The material handling attachment of claim 1, further comprising a pallet for supporting said cargo load.

3. The material handling attachment of claim 2, wherein said pallet has left and right openings therein, said left and right openings for receiving corresponding left and right said second straps.

4. The material handling attachment of claim 3, further comprising a safety chain for joining said front and rear cross member to the forklift truck.

5. The material handling attachment of claim 4, wherein said framework is rectangular and having four corners.

6. The material handling attachment of claim 5, wherein one said downwardly extending pad eye lifting lug is extended from each said corner of said framework.

7. A method of assembling a material handling attachment for a forklift truck, the forklift truck having left and right lifting forks, comprising the steps of:

(a) providing a framework having left and right tubular main frame members, each tubular main frame member having a conduit inside for receiving the corresponding left and right lifting forks of the forklift truck therein, wherein the conduit is open on opposite ends thereof;

(b) placing a front and rear cross member on an upper surface of the left and right tubular main frame member and an expended metal floor on the upper surface of the left and right tubular main frame member for storing items thereon;

(c) placing a left and right angle iron wall on opposite edges of the expanded metal floor so that outer edges of the expanded metal floor are covered so that items are contained on the expanded metal floor;

(d) providing a plurality of downwardly extending pad eye lifting lugs on the framework;

(e) providing a first strap extending from each downwardly extending pad eye lifting lug;

(f) providing a cargo load carried by a plurality of second straps; and (g) wherein the first straps are removably connected to the second straps to permit the cargo load to be carried by the forklift truck.

8. The method of claim 7, further comprising the step of providing a pallet for supporting the cargo load.

9. The method of claim 8, wherein the pallet has left and right openings for receiving left and right second straps.

10. The method of claim 9, further comprising the step of providing a safety chain for joining the front and rear ross member to the forklift truck.

11. The method of claim 10, wherein the framework is rectangular and has four corners.

12. The method of claim 11, wherein one downwardly extending pad eye lifting lug is extended from each corner of the framework.

* * * * *